United States Patent [19]

Gonzales et al.

[11] 3,966,072

[45] June 29, 1976

[54] COLLAPSIBLE CONTAINER

[75] Inventors: Joseph M. Gonzales; Armond J. Page, both of Boonsboro, Md.

[73] Assignee: Fairchild Industries Inc., Germantown, Md.

[22] Filed: June 13, 1974

[21] Appl. No.: 478,893

[52] U.S. Cl. ..... 220/7

[51] Int. Cl.[2] ..... B65D 7/30

[58] Field of Search ..... 220/4 F, 6, 7

[56] References Cited

UNITED STATES PATENTS

| | | | |
|---|---|---|---|
| 1,337,167 | 4/1920 | Trego | 220/7 |
| 2,553,607 | 5/1951 | Rosenberg | 220/6 |
| 2,640,620 | 6/1953 | Walket | 220/6 |
| 2,658,647 | 11/1953 | Stoner | 220/6 |
| 2,868,406 | 1/1959 | Kookogcy | 220/7 |

*Primary Examiner*—George E. Lowrance
*Attorney, Agent, or Firm*—Michael W. York

[57] ABSTRACT

A collapsible container including a flat rectangular shaped base, an end wall portion rotatably connected to each end of the base and two slidable side wall portions whose ends slide into and are received by the edges of the end wall portions. Latches are provided on the side wall portions for locking the side wall portions to the end wall portions to prevent the side wall portions from moving when the container is in an inverted position. Leg members are also attached to the corners of the base and these leg members have stacking members which permit the erected containers to be readily stacked on top of each other. The container is also easily collapsible into a compact configuration with no loose components which might be subject to being lost.

1 Claim, 10 Drawing Figures

FIG. 1
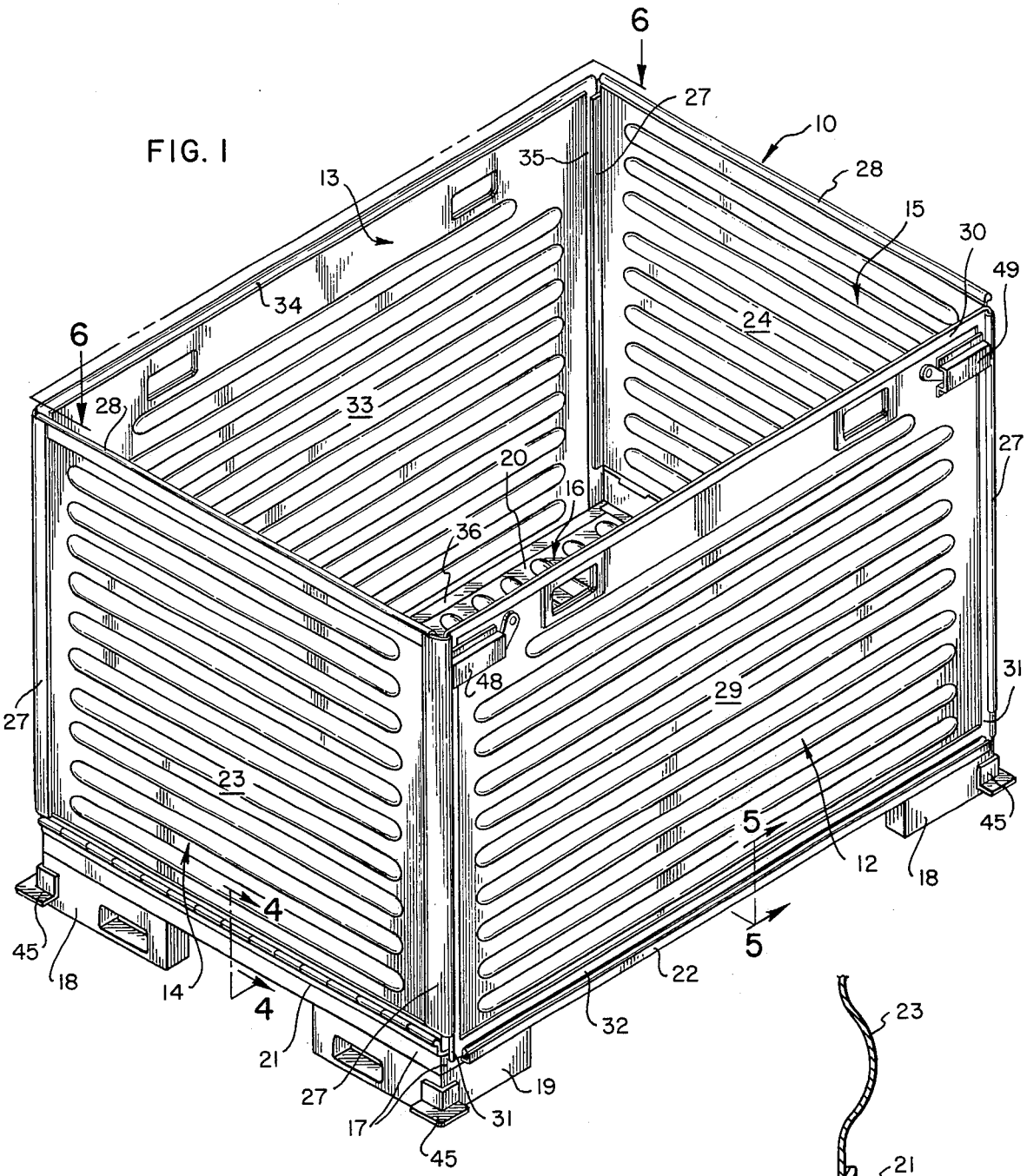
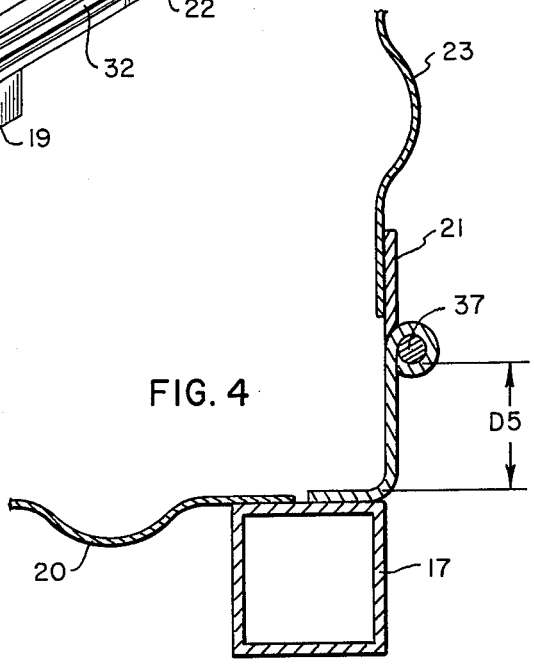
FIG. 4

COLLAPSIBLE CONTAINER

BACKGROUND OF THE INVENTION

In the fields of processing, storing, shipping and distributing merchandise there is a large economic advantage in handling the merchandise in containers as unit loads. There is an additional large economic advantage if the container utilized for each of the above types of operations is well suited for all the types of operations to which it is likely to be subjected. In processing merchandise it is normally necessary to move the merchandise from one work station to another, to place merchandise into a container, and to remove the merchandise from the container. Consequently, it is highly desirable that a container readily permit all of these operations. Merchandise is normally moved about plants and warehouses by means of gravity and powdered roller conveyors, unit load carrier vehicles, platform trucks, forklift trucks, and the like and a useful container must be adapted to be moved in such a manner or by such vehicles.

In order to prevent damage to merchandise, it is highly desirable that the container that is being loaded be capable of permitting a person who is filling the container to place the merchandise onto the floor of the container without having to drop the merchandise. For speed, fatigue reduction, and prevention of damage to the merchandise, it is also desirable that the person loading the container not be required to either at a the waist when placing merchandise onto the floor of the container or drop the merchandise to the floor of the container. An economical container for processing merchandise should also be capable of being emptied by mechanical means, such as dumpers and the like which discharge the merchandise through the top or other opening of the container. At the same time it is also desirable to have a container which can be easily emptied, if desired, by manual means by providing clear access to the container or its merchandise In order to efficiently utilize space, it is necessary to store merchandise in a vertical fashion so that the use of floor area is minimized. Consequently, a useful container should be capable of being stacked or tiered to six or more levels in height. Moreover, the containers should be capable of being easily tiered by means of highlift/forklift devices or the like.

It is also important in the operations of shipping and distributing merchandise to efficiently utilize the cubic capacity of the transport vehicle. An economical shipping container should have a configuration which will efficiently utilize the cubic and weight capacity of a large variety of vehicles; including highway vehicles, pick-up trucks, railway gondola cars and aircraft. A properly configured container is important since it eliminates the need to transfer merchandise from one type of a container to another. From an economical standpoint, it is also highly desirable to have a container which can be broken down or collapsed when it is empty in order to substantially reduce its volume so that on return shipment of empty containers the cost of shipping, which is most often base on cubic volume, can be minimized. Furthermore, such a container should be easily broken down or collapsed and be capable of being erected quickly by one man without using tools. Furthermore, a container should have few pieces so that its parts are not susceptable to becoming misplaced.

There have been many attempts in the past to obtain these desirable characteristics in a container for handling merchandise and in particular there are a variety of collapsible containers that have been developed in the past. U.S. Pat. Nos. 3,446,415; 3,557,855; and 3,570,698 all disclose containers and the like that have end panels which are rotatable inward to permit the containers to be collapsed into a fairly compact package. U.S. Pat. No. 2,998,894 also discloses a shipping container that has removable and slidable end panels. U.S. Pat. No. 3,401,814 also discloses a collapsible shipping container that has slidable and removable end and said panels. Although these patents illustrate a number of collapsible shipping containers that have been developed in the past, they are suffer from various deficiencies. For instance, the collapsible containers disclosed in the U.S. Pat. Nos. 3,446,415; 3,557,855 and 3,570,698 do not permit ready access to merchandise that is located in the container. For example, in U.S. Pat. No. 3,446,415 all of the sides and end panels rotate outwardly and thus interfer with access to articles in the container. Furthermore, the end panels must be folded in before sides can be released. In U.S. Pat. No. 3,570,698, the sides of the container interfere with access to articles located in the container since they cannot be folded until the articles are removed from the container. The collapsible container disclosed in U.S. No. 3,557,855 has wires or ropes that interfere with the convenient loading or removal of articles from the container and also to top lid is required for rigidity. U.S. Pat. No. 3,401,814 discloses a shipping container that has a large number of parts that can easily be lost or mislaid. Moreover, none of these above referenced patents discloses a collapsible lightweight container that has the capability of being readily stackable.

The collapsible container of this invention overcomes many disadvantages associated with previous collapsible containers and provides a container having a lightweight structure which is readily stackable and has few parts that can be lost or mislaid. Moreover, the collapsible container of this invention can be easily erected or collapsed, be easily loaded or unloaded and can be readily moved about.

BRIEF DESCRIPTION OF THE INVENTION

This invention relates to containers and more particularly to containers that can be collapsed into a compact configuration.

It is an object of the present invention to provide a collapsible container which is readily collapsible.

It is also an object of the present invention to provide a collapsible container which is readily erectable without the need for tools.

It is also an object of the present invention to provide a collapsible container that is light in weight.

It is also an object of the present invention to provide a collapsible container that is easy to load or unload.

It is also an object of the present invention to provide a collapsible container that is readily stackable.

It is also an object of the present invention to provide a collapsible container that can withstand the great loads associated with stacking containers to comparatively great heights.

It is a further object of the present invention to provide a collapsible container which is readily suited for a multiplicity of operations.

It is a further object of the present invention to provide a collapsible container which can be readily emptied by mechanical means.

The present invention provides a collapsible container which has a base, two substantially opposing wall portions rotatably connected to the base and two substantially opposing slidable wall portions. The slidable wall portions are removable from the container and they have means located on them for preventing movement of the slidable wall portions when the container is in its assembled configuration. The wall portions which are rotatably connected to the base are each rotatable inwardly to occupy the position above the upper surface of the base when the container is in a collapsed configuration.

BRIEF DESCRIPTION OF THE DRAWINGS

The invention will be hereinafter more fullly described with reference to the accompanying drawings in which:

FIG. 1 is a perspective view of the collapsible container of the present invention in its assembled configuration;

FIG. 4 is a sectional view taken on the plane indicated by the line 4—4 in FIG. 1;

DETAILED DESCRIPTION OF THE PREFERRED EMBODIMENT

Figures 2, 5:
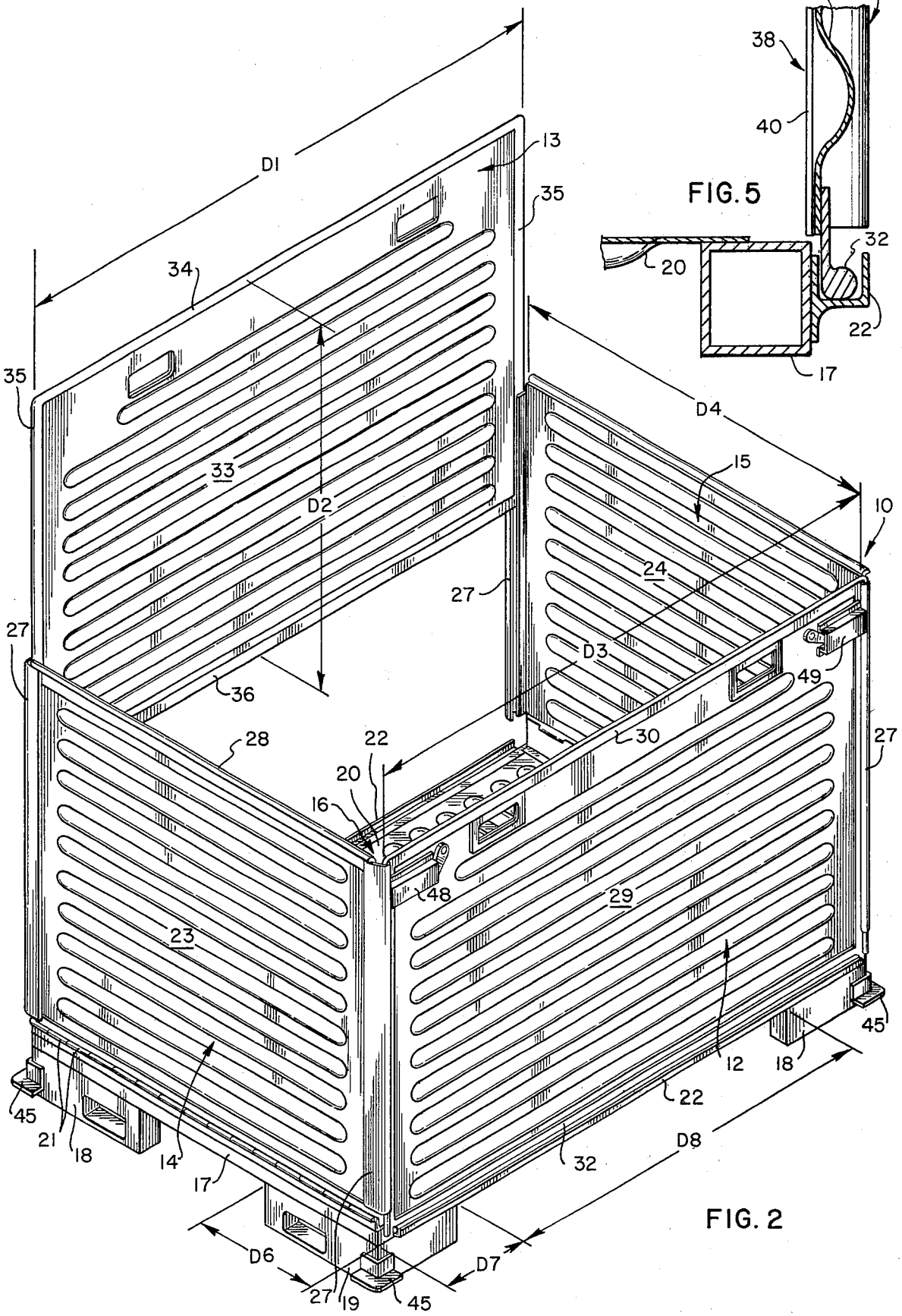
FIG. 2 is a perspective view of the structure illustrated in FIG. 1 with one of the slidable sides of the container in the process of being removed.
FIG. 5 is a sectional view taken on the plane indicated by the line 5—5 in FIG. 1.
Figure 3:
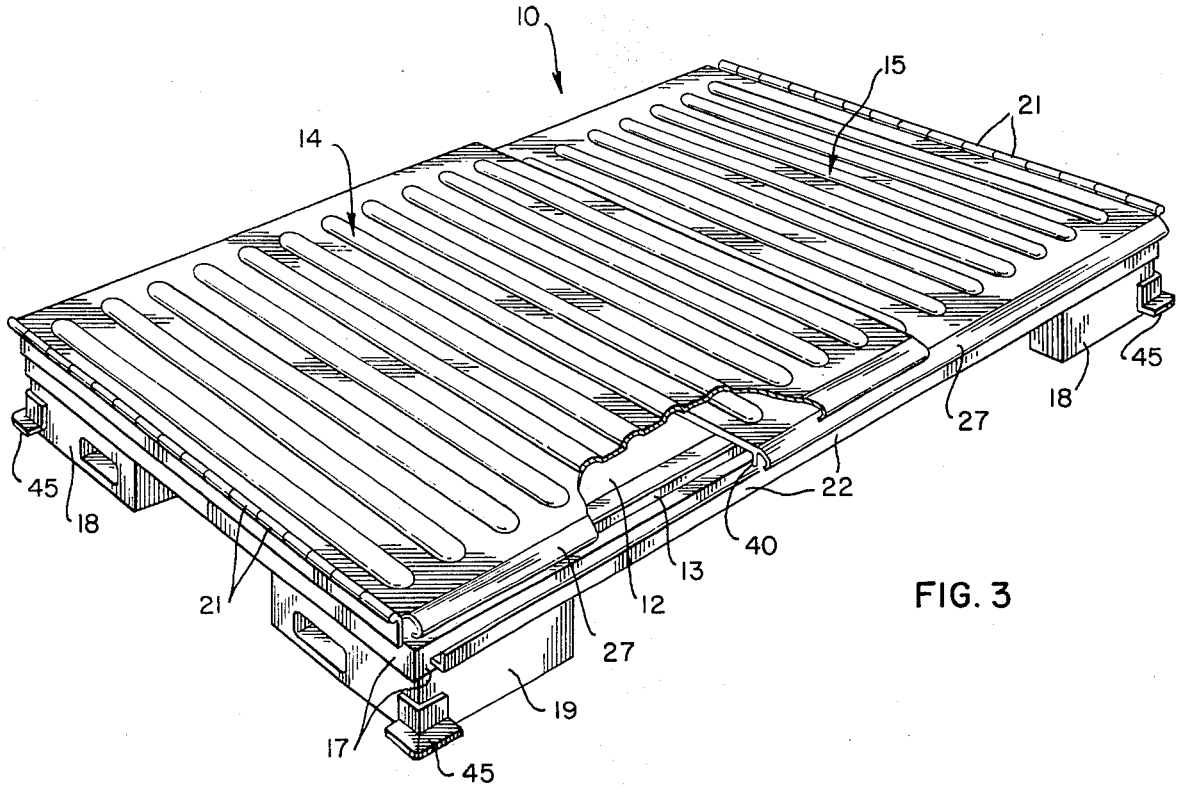
FIG. 3 is a perspective view of the structure illustrated in FIGS. 1 and 2 illustrating the container in its collapsed configuration.

Referring first to FIGS. 1 through 3 to collapsible container of the present invention is illustrated and is designated generally by the number 10. The collapsible container 10 comprises sidewall portions 12 and 13, end wall portions 14 and 15 and a base 16. The base 16 is generally polygonal shaped and comprises a tubular rectangular frame 17. Two leg or support members 18 are connected and extend downward from two of the opposite corners of the frame 17. Two substantially similar leg members 19 are connected to the other corners of the frame and extending downward therefrom. A floor panel member 20, which forms part of the base 16, is also connected to the upper surface of the frame 17. The floor panel member 20 has a beaded type construction and the beads in the floor panel member have their longest dimensions running in a direction across the width or shortest dimension of floor panel member to most efficiently transfer loads to the frame 17. This produces a very rigid panel member with good resistance to deflection due to loads.

An elongated hinge member 21 is connected to the lower end of each wall portion 14 and 15 and also to the adjacent portion of the frame 17. These hinge members 21 permit the end wall portions 14 and 15 to be pivoted inward and to be placed upon the top of the floor panel 20 of the base 16 or if it is desired the end wall portions can be pivoted outwardly to permit convenient access to articles that might be located on top of the base. An elongated L-shaped channel member 22 is located along and is rigidly attached to each side of the frame 17. The channel member 22 is adapted to receive and capture the lower edge of the respective sidewall portion 12 or 13 to prevent the sidewall portions from being deflected outward when the container 10 is loaded or being loaded.

The end wall portions 14 and 15 both comprise panels 23 and 24 having beaded construction with a long dimension of the beads of the respective panels running in a direction toward elongated side frame female channel members 27 which are rigidly connected to the edges of the ends of the panels. The end wall portions 14 and 15 also have an elongated top frame member 28 which is connected to the upper end of each beaded panel 23 and 24.

The sidewall portion 12 comprises a beaded panel 29, an elongated top frame member 30 which is connected to the upper edge of the beaded panel, elongated side frame members 31 connected to each outer edge of the beaded panel and an elongated bottom frame member 32 that is connected to the lower edge of the beaded panel and is adapted to be received by and fit into the L-shaped channel member 22. In a similar manner, the sidewall portion 13 comprises a beaded panel 33, an elongated top frame member 34 connected to the upper edge of the beaded panel, elongated side frame member 35 connected to the outer edges of the beaded panel and an elongated bottom frame member 36 that is connected to the lower edge of the beaded panel and is adapted to be received by and fit into the opposite L-shaped channel member 22.

As best illustrated in FIG. 2 the sidewall portions 12 and 13 are adapted to be inserted into the respective sides of end wall portions 14 and 15 by lowering the sidewall portions in such a manner that the respective side frame members 31 or 35 of the sidewall portions slide into and are received by the respective side frame female channel members 27 of the end wall portions 14 and 15. Continued lowering of the sidewall portions 12 or 13 causes the bottom frame members 32 or 36 of the respective sidewall portions to be guided into and be captured by respective channel member 22 on the base 16.

Certain dimensions associated with the various components of the collapsible container 10 of this invention are important for proper functioning. As illustrated in FIG. 2, dimension D1 is the length dimension of the sidewall portion 12 or 13, since the length of the sidewall member 13 is substantially the same as that of the sidewall member 12. Also, as illustrated dimension D2 is the width dimension of the sidewall portion 12 or 13 since the widths of these two members are substantially identical. Dimension D3 is the inside length dimension of the assembled container 10 and the dimension D4 is the inside width of the dimension of the assembled container. It is important for the proper functioning of the collapsible container 10 of this invention that the dimension D1 be less than the dimension D3 and that the dimension D2 be less than the dimension D4. As illustrated in FIG. 3, this is necessary in order to make it possible to lay the removable sidewall portions 12 and 13 on top of the floor panel 20 between the hinged end wall portions 14 and 15 so that the hinged wall portions 14 and 15 may be folded down over the top of the removable sidewall portions 12 and 13 in order to form a compact low volume arrangement or configuration for shipment when the containers are to be shipped empty or for storage.

As illustrated in FIG. 4, it is necessary for the proper operation of the collapsible container 10 of this invention that the pin 37 of each of the hinge members 21 be located at a distance D5 above the upper surface of the floor panel member 20 of the base 16 that is at least as great as the combined width of the two side portions 12 and 13 when they are lying one on top of the other on the upper surface of the floor panel member 20. This is necessary in order to permit the end wall portions 14 and 15 to be rotated inward and down upon the stacked sidewall portions 12 and 13 to permit the collapsible container 10 to form a compact package in its collapsed configuration as illustrated in FIG. 3.

Figure 6:
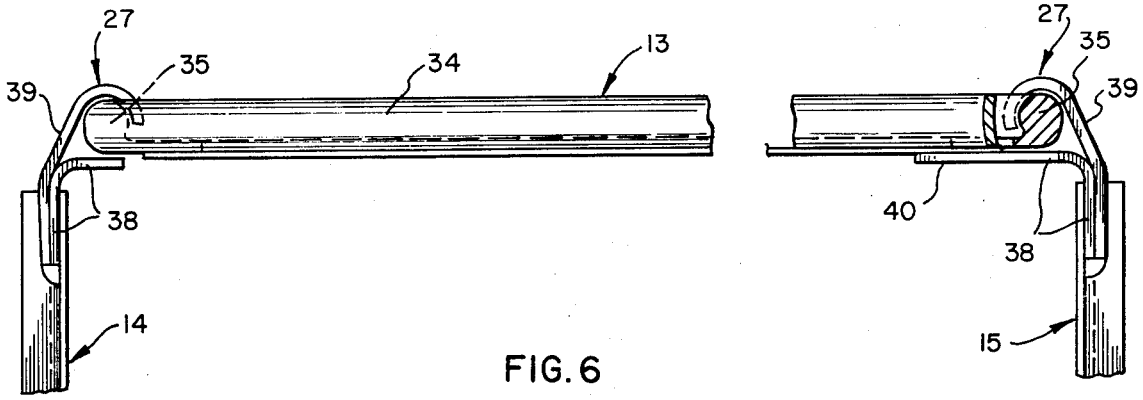
FIG. 6 is a top view taken generally on the line 6—6 in FIG. 1.

As best illustrated in FIGS. 5 and 6, an elongated L-shaped support member 38 is provided which forms a part of each side frame female channel member 27. This support member 38 runs for substantially the entire length of the female channel member 27 and supports the slidable sidewall portions 12 and 13 in an upright position and prevents them from being pushed inward when the container 10 is in its assembled configuration. As illustrated, the support member 38 works in conjunction with the curved portion 39 of the female channel member 27 which prevents the slidable sidewall portions 12 and 13 from moving in an outward position when the container is in its assembled configuration. However, the L-shaped support member 38 also serves another purpose when the collapsible container 10 is in its collapsed configuration. In the collapsed configuration, the support member 38 and the hinge members 21 associated with the rotatable end wall portions 14 or 15 prevent the slidable end wall portions 12 and 13 which are located on top of the floor panel 20 from moving outward and off of the floor panel. This is so because the flange 40 of the support members 38 of one end wall portion block the path of possible sidewise movement of the slidable panels 12 and 13, as illustrated in FIGS. 3 and 6. As a consequence, the slidable sidewall members 12 and 13 cannot become inadvertently dislodged or lost from the rest of the container 10 during shipment in its collapsed configuration.

Figure 7:
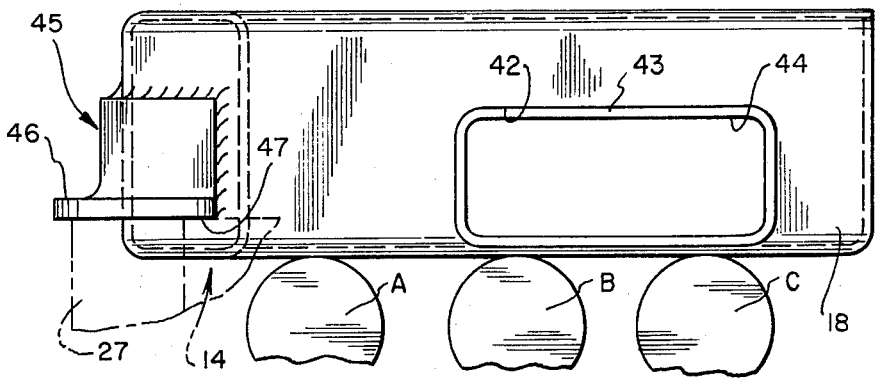
FIG. 7 is an enlarged side elevational view illustrating a support member that forms part of the present invention.

As best illustrated in FIG. 2 and FIG. 7, the leg members 18 and 19 also act as conveyor runners. Since the leg member dimension D6 is sufficiently large that the leg members 18 and 19 are capable of at all time contacting at least two of the rollers A, B and C of a gravity or power roller conveyor so that the container may be conveyed on these types of conveyors without bucking. In other words, the leg members 18 and 19 ride smoothly over the rollers A, B and C and do not contact the rollers except on the top point of the rollers. The same is true of this other length dimension D7 so that the leg 18 or 19 is sufficiently long in that direction that it may contact at least two rollers of a gravity or power roller conveyor. Consequently, the collapsible container 10 may be smoothly conveyed on these types of conveyors in any of two directions, that is, along the long axis in the direction of conveyor motion and also along the short axis in the direction of conveyor motion. This is an important practical feature of the present invention since it permits the collapsible container 10 of this invention to be more rapidly and easily transported on such conveyors.

It is also important to note that the leg dimension D7 is not made any longer than necessary since it is necessary to have a dimension D8 between the two leg members that is sufficiently large so that it is possible to provide sufficient clearance for a forklift type device. This is another important feature of the improved collapsible container of this invention since containers and the like which incorporate conveyor runners that extend the entire length of a conveyor only permit a forklift device to be introduced beneath the container whereas with the present invention a wheeled low lift device can be introduced beneath the container with no interference with the wheels of the low lift device.

Figure 8:
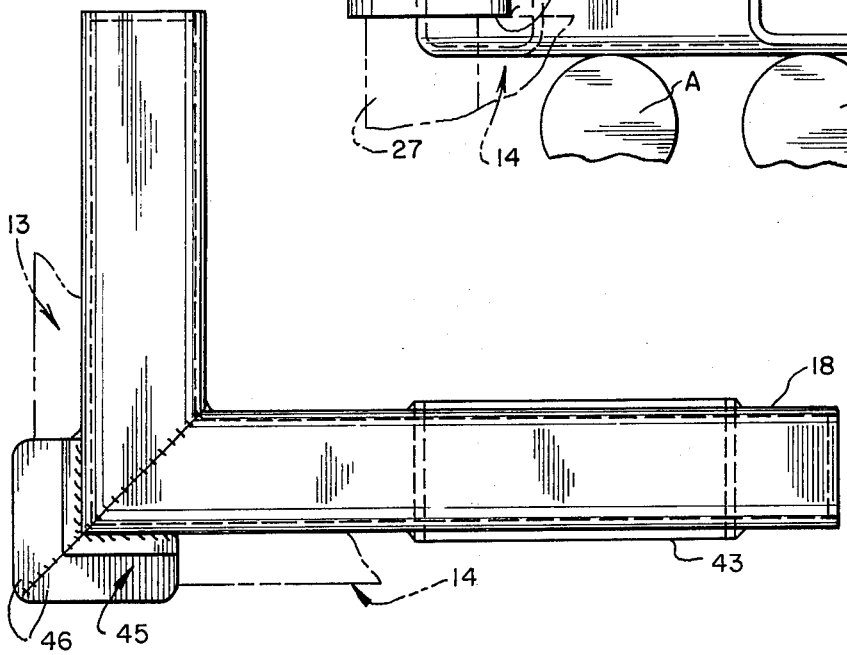
FIG. 8 is a top view of the structure illustrated in FIG. 7.

Several other important features of the present invention are best illustrated in FIGS. 7 and 8. As illustrated, for the leg member 18 one side of each leg member 18 and 19 contains an opening 42 into which a hollow substantially rectangular shaped cross section reinforcing tube 43 has been inserted. The opening 44 in the reinforcing tube 43 serves the purpose of providing means for grasping or holding the container 10 by mechanical handling equipment. The mechanical handling equipment may include either dumpers (not shown) that discharge merchandise from the container by turning the conveyor over through an angle of say 135° or more or unit load carrier vehicles (not shown) that transport the container 10 through a processing plant. Such a unit load carrier might transport the container 10 and down steep inclines or declines. The reinforcing tube 43 transmits the load impressed by mechanical handling equipment into the base 16 of the container 10 which is designed to provide adequate strength to withstand any overturning moments that may be encountered.

As illustrated in FIGS. 1 through 3 each of the four leg members 18 and 19 incorporates a protrusion or stacking member 45 on its corner for stacking containers 10 one on top of another. The details associated with such protrusions or stacking members 45 are best illustrated in FIGS. 7 an 8. As illustrated for the leg member 18 the stacking member 45 is located on the outer corner of the leg member 18 or 19 and it has an outward extending flange 46 with a flat lower surface 47 that is adapted to rest on and contact the upper surfaces of a corner of the container upon which the container is to be stacked as illustrated in phantom in FIGS. 7 and 8. When the collapsible containers 10 are stacked one upon another, it should be noted that a lower portion of the leg members 18 and 19 extends into the open end of the container below it and this tends to prevent lateral movement of the upper container 10 and keep it from sliding off the lower container 10. It should also be noted that the four stacking members 45 rest on top of the four corners established by the joined end and sidewall portions of the lower container. Two of such corners are illustrated in FIG. 6 where it should be noted that the female channel member 27 and the joined ends of the top frame member 34 and the side frame member 35 will all come in contact with the lower surface 47 of the stacking member 45. All these members provide a very rigid corner that is capable of transmitting comparatively high loads that cannot be transmitted by other portions of the container 10. It is an important advantage of this improved container 10 that the protrusion of stacking members 45 are located in such a way so as to rest upon the most rigid vertical load path to the base 16 of a lower container 10 and thereby provide a container which can endure large stacking loads and yet be of lightweight construction. This is a definite improvement over containers in the prior art which transmit stacking loads to the walls of the container rather than to their corners since such containers require stronger walls which result in a heavier container.

Figure 9:
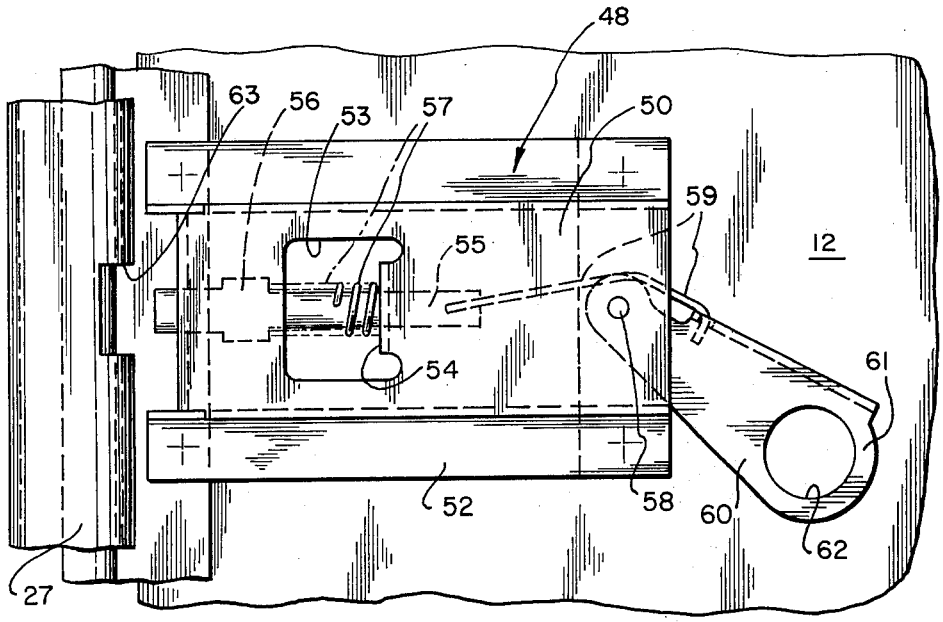
FIG. 9 is an enlarged side elevational view of latch means that forms part of the present invention.

As illustrated in FIGS. 1 and 2 each of the slidable wall portions 12 and 13 is equipped with two substantially identical latch members 48 and 49. The purpose of the latch members 48 and 49 is to secure the slidable sidewall portions 12 and 13 to the end wall portions 14 and 15 so that the container 10 may be overturned in dumping operations without having sidewalls 12 and 13 becoming dislodged from the container. The details associated with the latch members 48 and 49 are illustrated for the latch member 48 in FIGS. 9 and 10. The latch member 48 comprises a generally U-shaped cross section frame member 50 that has flanges 51 and 52 which are riveted or welded to the wall of the slidable sidewall portion 12 or 13 near its edge. A generally rectangular shaped aperture 53 is provided in the outer surface of the U-shaped frame member 50 and a tab 54 is bent inward at the inner edge of this aperture. This tab 54 has an aperture which slidably receives a latch bar 55 that has an enlarged portion 56. A coil compression spring 57 has one end located against the enlarged portion and the other end rests against the tab 54. This spring 57 causes the latch bar 55 to be biased in an outward direction. The inner end of the frame member 50 has an aperture and a pin 58, which pivotally mounts the end of a handle 60 which is partially located within the housing member 50, is located in the aperture. The handle 60 has an outer enlarged end portion 61 which is provided with a circular aperture 62. A connecting link 59 has one end connected to the adjacent end of the latch bar and the other end connected to the handle 60. As a consequence when the handle 60 is in the lower position the spring 57 is compressed by the pull of the connecting link 59 which causes the withdrawal of the latch bar from a latch slot 63 in the adjacently located female channel member 27.

Figure 10:
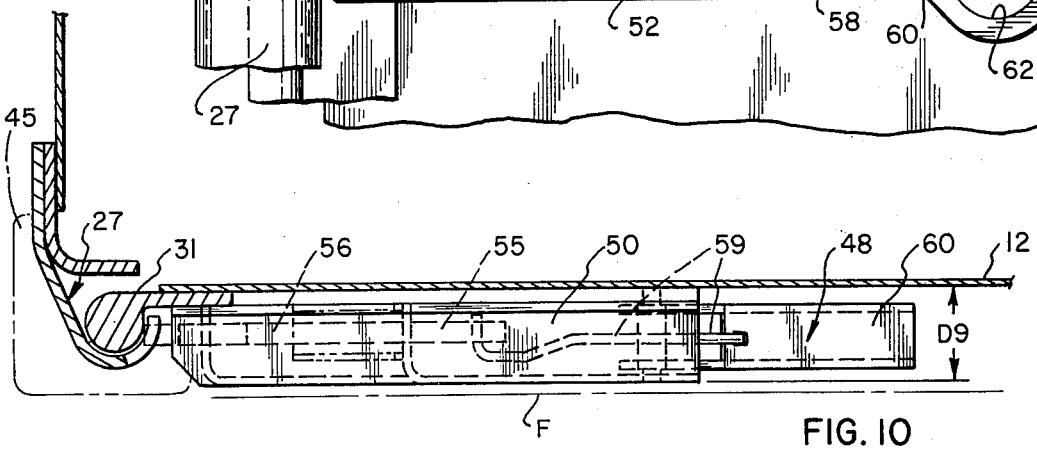
FIG. 10 is a top view of the structure illustrated in FIG. 9.

It is important to note that the spring 57 exerts a force on the handle but since the attachment position of the end of the connecting link 59 is below the level of the handle pivot axis or the pivot pin 58 when the handle is lowered, the compression spring force keeps the handle in the lower position and the latch bar 55 withdrawn from the slot 63 without any force being required to be exerted on the outer end of the handle 60. This is important since it permits the container to readily be assembled by one man which might not be possible with other types of prior art latching devices. Of course, when the handle 60 is nudged toward the upward position the compression spring 57 exerts an outward force upon the latch bar 55 and causes the latch bar to engage the slot 63. The latch members 48 and 49 are located in a convenient position for manual actuation when collapsing or erecting the container and also minimal forces are required for their operation. Furthermore, it is important to note as illustrated in FIG. 10 that the width D9 of the latch member 48 or 49 is sufficiently small that no portion of the latch member extends outside of the outer confines F of the erected container 10, including its stacking members 45. Consequently, the containers 10 can be readily stacked close to each other without taking up needless space.

Normally the collapsible container 10 of the invention is shipped or stored in its collapsed configuration which is illustrated in FIG. 3. When it is desired to erect and use the collapsible container 10 the end wall portions 14 and 15 are pivoted upwardly and outwardly and this exposes the slidable sidewall portions 12 and 13 which were located beneath the end wall portions when the container was in its collapsed configuration. The latch members 48 and 49 on the slidable sidewall portions 12 and 13 are then set in their unlocked positions. The hinged end wall portions 14 and 15 are then placed in an upright position. As illustrated in FIG. 2, for the slidable panel member 13, the lower ends of the slidable sidewall portions 12 and 13 are inserted into the female channel members 27 of the respective end wall portions 14 and 15, and the slidable sidewall portions are then pushed downward and into the channel member 22.

The latch members 48 and 49 on the slidable sidewall portions 12 and 13 are then moved to their latched position. If desired, to permit easy filling of the container 10, one of the slidable sidewall portions 12 or 13 can be omitted until the container is fully or partially loaded. After loading, the loaded container 10 can then be stacked or stored with its stacking members 45 resting on the corners of the container located below it or the loaded container can be smoothly transported on a roller conveyor in view of its leg members 18 and 19.

In view of the construction of the leg members 18 and 19 the collapsible container 10 can be placed upon the roller conveyor without the need for precise orientation. The collapsible container 10 can also be easily moved about by a forklift which can be introduced from any end of the container. The collapsible container 10 is also readily adapted to be handled by mechanical handling equipment which can engage the reinforcing tubes 43 in the leg members 18 and 19.

When it is desired to unload the container 10 one or both of the slidable sidewall portions 12 or 13 can be removed so that the article can be readily removed from the container. After the container has been unloaded the slidable sidewall portions 12 and 13 are then placed upon the upper surface of the base 16 and the hinged end wall portions 14 and 15 are pivoted inwardly and placed on top of the slidable sidewall portions 12 and 13. This results in the collapsible container 10 having the compact collapsed configuration illustrated in FIG. 3. In this collapsed configuration the collapsible container 10 takes up very little space and thus it can be readily transported or stored without taking up valuable shipping or storage space.

Although the invention has been described in considerable detail with reference to a preferred embodiment, it will be understood and appreciated that variations may be made within the spirit and scope of the invention as defined in the appended claims.

What is claimed is:

1. A collapsible container comprising a base, two substantially opposing wall portions rotatably connected to said base, said rotatably connected wall portions each being rotatable inwardly to occupy a position above the upper surface of said base when said container is in the collapsed configuration, and two substantially opposing slidable wall portions, said slidable wall portions being removable from said container wherein the improvement comprises means for preventing said slidable wall portions from being dislodged from said container when said container is in the erected configuration, said dislodgment preventing means comprising latch means located on the upper portion of at least some of said wall portions, said latch means comprising a handle for moving the latch means to its open or closed position, a spring for exerting a force on said handle, a latch member associated with said spring, a pivot pin about which said handle pivots and a connecting link member which interconnects said latch member and said handle, the attachment position of said connecting link member to said handle being located below the level of said pivot pin when said latch means is in the open position, said latch means being totally located within the outer confines of the erected container.

* * * * *